US007890021B2

(12) United States Patent
Yuzawa

(10) Patent No.: US 7,890,021 B2
(45) Date of Patent: Feb. 15, 2011

(54) DEVELOPING CARTRIDGE AND IMAGE FORMING APPARATUS

(75) Inventor: Atsuyuki Yuzawa, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 18 days.

(21) Appl. No.: 12/558,969

(22) Filed: Sep. 14, 2009

(65) Prior Publication Data

US 2010/0067947 A1 Mar. 18, 2010

(30) Foreign Application Priority Data

Sep. 18, 2008 (JP) ..... 2008-239271

(51) Int. Cl.
*G03G 15/04* (2006.01)

(52) U.S. Cl. ..... 399/119

(58) Field of Classification Search ..... 399/110, 399/111, 114, 119

See application file for complete search history.

(56) References Cited

U.S. PATENT DOCUMENTS

| | | | | |
|---|---|---|---|---|
| 4,583,832 | A * | 4/1986 | Kasamura et al. | 399/119 |
| 7,428,386 | B2 * | 9/2008 | Itabashi | 399/12 |
| 7,835,665 | B2 * | 11/2010 | Okabe et al. | 399/113 |
| 2007/0071494 | A1 | 3/2007 | Igarashi et al. | 399/110 |

FOREIGN PATENT DOCUMENTS

| | | |
|---|---|---|
| JP | 2007-121983 | 5/2007 |

* cited by examiner

*Primary Examiner*—Hoang Ngo
(74) *Attorney, Agent, or Firm*—Fitzpatrick, Cella, Harper & Scinto

(57) ABSTRACT

A developing cartridge includes a developer carrying member for supplying a developer to an image bearing member; a protecting member provided movably between a closing position where the protective member covers the carrying member and an opening position where the protective member exposes the carrying member; a shifting member for shifting the cartridge, mounted to the mounting portion, between a operable position where the carrying member operably opposes the image bearing member and a separation position where the carrying member is moved away from the operable position; a grip portion provided movably between a first position and a second position; and an interrelating member for interrelating the cartridge with the grip portion. In a state where the cartridge is mounted to mounting portion, the interrelating member shifts the cartridge from the separation position to the operable position by the shifting member while moving the protecting member from the closing position to the opening position in interrelation with movement of the grip portion from the first position to the second position, and shifts the cartridge from the operable position to the separation position by the shifting member while moving the protecting member from the opening position to the closing position in interrelation with movement of the grip portion from the second position to the first position.

7 Claims, 12 Drawing Sheets

DEVELOPING CARTRIDGE AND IMAGE FORMING APPARATUS

FIELD OF THE INVENTION AND RELATED ART

The present invention relates to a developing cartridge and an image forming apparatus.

The image forming apparatus forms an image on a recording material (medium) and may include, e.g., a copying machine, a printer (such as a laser beam printer or an LED printer), a facsimile machine, or a multi-function machine with functions of these machines. These machines are of an electrophotographic type, an electrostatic recording type, a magnetic recording type, and the like.

The image forming apparatus includes an image bearing member. On the image bearing member, a latent image (such as an electrostatic latent image, a potential latent image, a resistance latent image, or a magnetic latent image) to be developed with a developer is formed. Examples of the image bearing member may include an electrophotographic photosensitive member in an electrophotographic process, an electrostatic recording dielectric member in an electrostatic recording process, and a magnetic recording magnetic member in a magnetic recording process.

The developing cartridge includes a developer carrying member for developing the latent image by supplying the developer to the image bearing member and is detachably mountable to a main assembly of the image forming apparatus. The apparatus main assembly is a portion of an image forming apparatus except the developing cartridge. The developing cartridge is mountable to and demountable from the apparatus main assembly by a user himself (herself). For that reason, maintenance of the apparatus main assembly can be easily performed.

As the image forming apparatus of the electrophotographic type, a tandem type color laser printer has been known. For example, an image forming apparatus described in Japanese Laid-Open Patent Application (JP-A) 2007-121983 includes a plurality of image forming units each including a photosensitive drum, a developing portion, a charging device, and the like. Each of the image forming units is accommodated in a box-like developing cartridge accommodating tray portion and is constituted so that the user can exchange a developing portion (developing cartridge) of each of the image forming units in a state in which the tray portion is pulled from a main assembly casing toward the user.

In such an image forming apparatus, when the developing cartridge is in a stand-alone state, a portion of the developing cartridge such as a developing roller is not protected from other portions of the image forming apparatus or an outside thereof.

For that reason, there is a possibility that the portion of the developing cartridge is damaged when the user effects mounting and demounting of the portion of the developing cartridge with respect to the main assembly casing in order to perform the maintenance or the like. Further, the portion of the developing cartridge is exposed, so that it is also considered that the developer in the developing cartridge scatter into the air.

SUMMARY OF THE INVENTION

A principal object of the present invention is to reduce a degree of damage of a developer carrying member and a degree of scattering of a developer and to improve usability by protecting the developer carrying member in a developing cartridge in a constitution of the developing cartridge.

According to an aspect of the present invention, there is provided a developing cartridge detachably mountable to a developing cartridge mounting portion of an image forming apparatus for forming an image on a recording material, the developing cartridge comprising:

a developer carrying member for supplying a developer to an image bearing member to develop a latent image formed on the image bearing member;

a protecting member provided movably between a closing position in which the protective member covers the developer carrying member and an opening position in which the protective member exposes the developer carrying member;

a shifting member for shifting the developing cartridge, mounted to the developing cartridge mounting portion, between a operable position in which the developer carrying member operably opposes the image bearing member and a separation position in which the developer carrying member is moved away from the image bearing member with respect to the operable position;

a grip portion provided movably between a first position and a second position; and an interrelating member for interrelating said developing cartridge with said grip portion, wherein in a state in which the developing cartridge is mounted to the developing cartridge mounting portion, the interrelating member shifts the developing cartridge from the separation position to the operable position by the shifting member while moving the protecting member from the closing position to the opening position in interrelation with movement of the grip portion from the first position to the second position, and shifts the developing cartridge from the operable position to the separation position by the shifting member while moving the protecting member from the opening position to the closing position in interrelation with movement of the grip portion from the second position to the first position.

According to another aspect of the present invention, there is provided an image forming apparatus for forming an image on a recording material, comprising:

a movable member, which supports an image bearing member and includes a developing cartridge mounting portion, movable between an outside position in which the movable member is located outside a main assembly of the image forming apparatus and an inside position in which the movable member is located inside the main assembly of the image forming apparatus; and a developing cartridge detachably mountable to the developing cartridge mounting portion, the developing cartridge comprising:

a developer carrying member for supplying a developer to an image bearing member to develop a latent image formed on the image bearing member;

a protecting member provided movably between a closing position in which the protective member covers the developer carrying member and an opening position in which the protective member exposes the developer carrying member;

a shifting member for shifting the developing cartridge, mounted to the developing cartridge mounting portion, between a operable position in which the developer carrying member operably opposes the image bearing member and a separation position in which the developer carrying member is moved away from the image bearing member with respect to the operable position;

a grip portion provided movably between a first position and a second position; and an interrelating member for interrelating said developing cartridge with said grip portion, wherein in a state in which the developing cartridge is mounted to the developing cartridge mounting portion, the interrelating member shifts the developing cartridge from the separation position to the operable position by the shifting member while moving the protecting member from the closing position to the opening position in interrelation with movement of the grip portion from the first position to the second position, and shifts the developing cartridge from the operable position to the separation position by the shifting member while moving the protecting member from the opening position to the closing position in interrelation with movement of the grip portion from the second position to the first position.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described with reference to the drawings. However, it should be understood that dimensions, materials, shapes, relative positions, and the like of constituent elements or means of a developing cartridge and an image forming apparatus according to the present invention are not limited to those described in the following embodiments unless otherwise specified.

Embodiment 1

General Structure of Image Forming Apparatus

The image forming apparatus in this embodiment is an electrophotographic image forming apparatus to which the developing cartridge is detachably mountable. A general structure of the image forming apparatus will be described with reference to FIGS. 1, 2 and 3.

Figure 1:
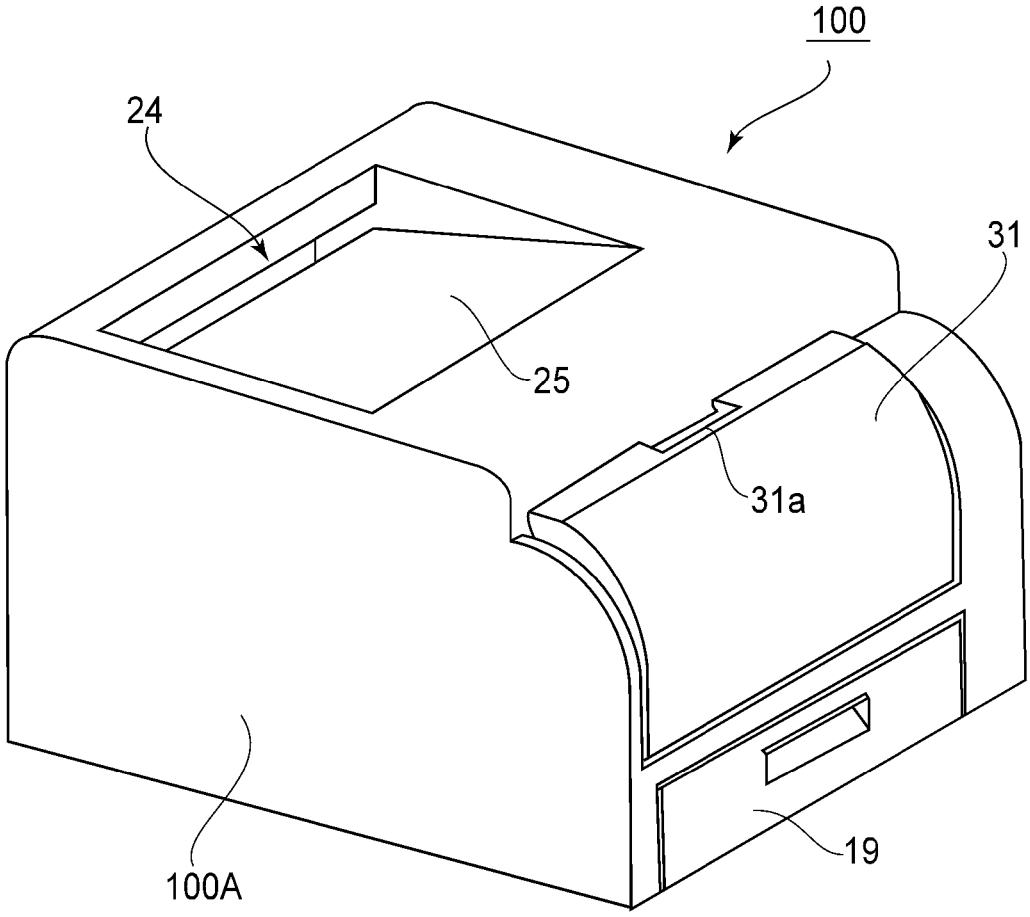
FIG. 1 is a perspective view of an outer appearance of an image forming apparatus in Embodiment 1.
Figure 2:
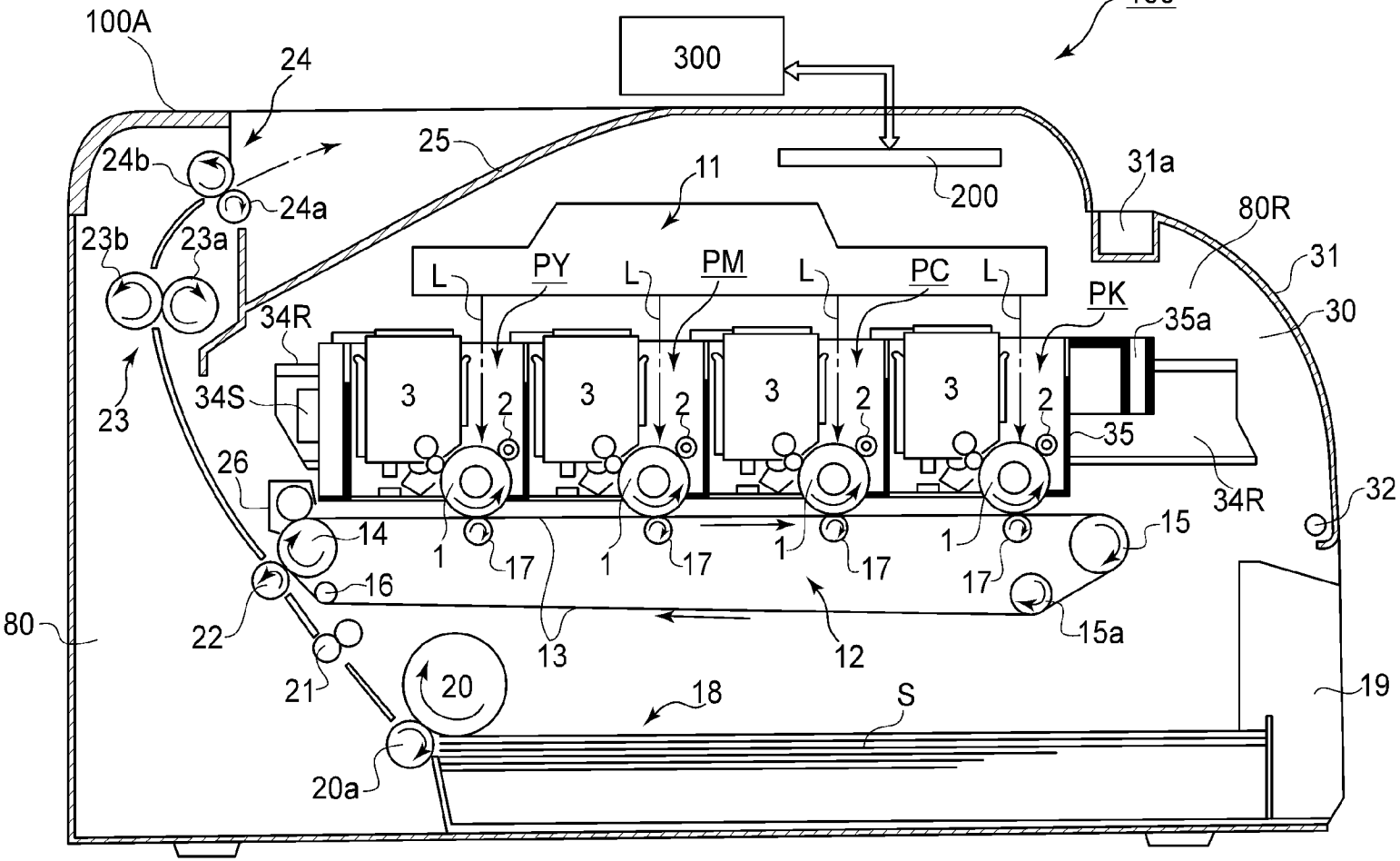
FIG. 2 is a longitudinal left side sectional view of the image forming apparatus of FIG. 1.
Figure 3:
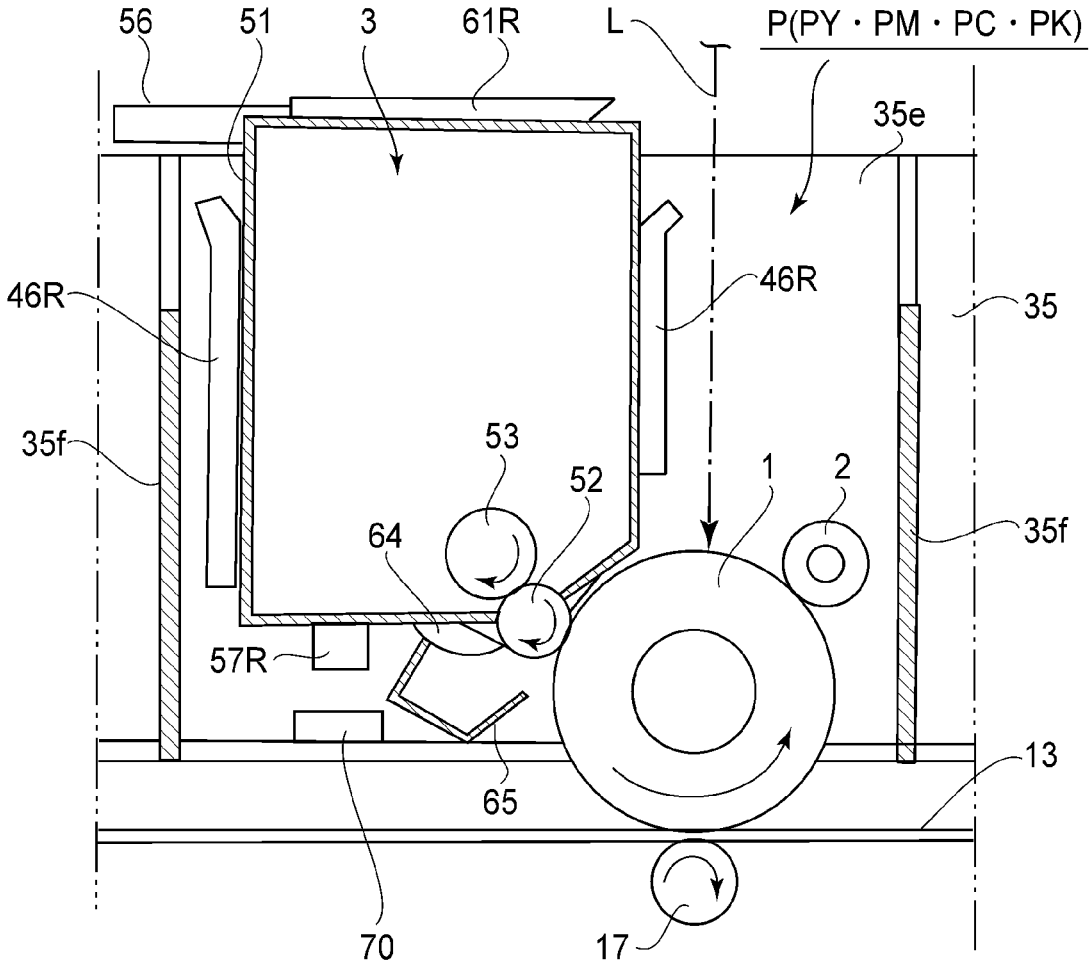
FIG. 3 is a partly enlarged view of FIG. 2.

FIG. 1 is a perspective view of an outer appearance of an image forming apparatus 100 in this embodiment, FIG. 2 is a longitudinal left side sectional view of the image forming apparatus 100, and FIG. 3 is a partly enlarged view of FIG. 2. The image forming apparatus 100 is a four color-based full-color laser printer using an electrophotographic process. That is, the image forming apparatus 100 forms an image on a sheet-like recording material (recording medium such as a sheet, an OHP sheet or a label) S on the basis of an electrical image signal input from a host device 300 such as a personal computer, an image reader, or a remote facsimile machine into a control circuit portion 200 of the image forming apparatus 100. The control circuit portion (control means such as a CPU) 200 exchange various pieces of electrical information with the host device 300 or an operating portion (not shown) and effects centralized control of an image forming operation of the image forming apparatus 100 in accordance with a predetermined control program and a predetermined reference table.

In the following description, a front side (front surface side) of the image forming apparatus 100 means the side on which a door 31 as an opening/closing member is provided. A rear side of the image forming apparatus 100 is the side opposite to the front side. A front-rear direction includes a frontward direction toward front as seen from the rear side of the image forming apparatus 100 and a rearward direction opposite to the frontward direction. The left and right sides means the left and right sides as seen from the front side of the image forming apparatus 100. A left-right direction includes a leftward direction toward left as seen from the front side and a rightward direction opposite to the leftward direction. An apparatus main assembly 100A is a portion of an image forming apparatus except the developing cartridge.

In the apparatus main assembly 100A, four (first to fourth) image forming portions P (PY, PM, PC, PK) are horizontally arranged in the listed order in terms of the rear-to-front direction (inline or tandem arrangement). The four image forming portions (image forming stations) P have the same constitution except that colors of developers (visualizing powder; hereinafter referred to as toners) are different from each other. Each image forming apparatus P in this embodiment includes a drum-type electrophotographic photosensitive member 1 as an image bearing member on which a latent image to be developed with the toner is formed (hereinafter simply referred to as a "drum"). The image forming portion P further includes a charging device 2 and developing device 3 which are used as process means acting on the drum 1. The charging device 2 is a charging means for electrically charging the surface of the drum 1 uniformly to a predetermined polarity and a predetermined potential and is a contact charging roller in this embodiment. The charging roller 2 is rotated by rotation of the drum 1 in contact with the drum 1 with a predetermined urging force. The developing device 3 is a developing means for developing the latent image formed on the surface of the drum 1 into a toner image with the toner. The developing device 3 is constituted as a developing cartridge detachably mountable to the apparatus main assembly 100A. Hereinafter, the developing device 3 is referred to as the developing cartridge. A constitution of the developing cartridge 3 in this embodiment will be described later.

The developing cartridge 3 of the first image forming portion PY stores yellow (Y) toner. On the surface of the drum 1 at the image forming portion PY, a toner (developer) image of yellow (Y) is formed. The developing cartridge 3 of the second image forming portion PM stores magenta (M) toner. On the surface of the drum 1 at the image forming portion PM, a toner image of magenta (M) is formed. The developing cartridge 3 of the third image forming portion PC stores cyan (C) toner. On the surface of the drum 1 at the image forming portion PC, a toner image of cyan (C) is formed. The developing cartridge 3 of the fourth image forming portion PK stores black (K) toner. On the surface of the drum 1 at the image forming portion PK, a toner image of black (K) is formed.

In the area above the first to fourth image forming portions PY, PM, PC, and PK, a laser scanner unit 11 as an exposure device is disposed. This scanner unit 11 outputs a beam of laser light L modulated correspondingly to image (picture) information for each color inputted from the host device 300 into the control circuit portion 200. The outputted laser light L enters each image forming portion. Thus, laser scanning exposure is performed on the surface of the drum 1.

The apparatus main assembly 100A includes an intermediary transfer belt unit 12. This belt unit 12 is disposed below the first to fourth image forming portions PY, PM, PC, and PK. The belt unit 12 includes an endless belt 13. The belt 13 is an intermediary transfer member (intermediary transfer belt) contactable to the drum 1 of each image forming portion P in order to form an image on a recording material (hereinafter referred to as a sheet) S. The belt 13 is formed of a dielectric material and has flexibility. Inside the belt 13, a driving roller 14, a turn roller 15, a turn roller 15*a*, and a tension roller 16 around which the belt 13 is stretched and circulatively moved. The driving roller 14 and tension roller 16 are disposed on the rear side of the apparatus main assembly 100A. The turn rollers 15 and 15*a* are disposed on the front side of the apparatus main assembly 100A. A lower surface of the drum 1 of each image forming portion P contacts an upper surface of an upper belt portion of the belt 13. Inside the belt 13, four primary transfer rollers 17 are disposed. Each transfer roller 17 is disposed opposite to the drum 1 at the corresponding image forming portion P through the upper belt portion of the belt 3. The driving roller 14 is disposed opposite to a secondary transfer roller 22 through the belt 13.

Below the belt unit 12, a sheet feeding unit 18 is disposed, which includes a sheet cassette 19 in which the sheets S are stacked and accommodated, a feeding roller 20, and a separation roller (retarding roller) 21. The sheet cassette 19 is detachably mountable in the apparatus main assembly 100A from the front side (front loading).

At an upper portion on the rear side of the apparatus main assembly 100A, a fixing device 23 and a sheet discharging roller pair 24 are disposed. Further, at an upper surface of the apparatus main assembly 100A, a sheet discharging portion 25 is provided. The fixing device 23 includes a fixation film assembly 23*a* and a pressing roller 23*b*. The sheet discharging roller pair 24 includes sheet discharging rollers 24*a* and 24*b*.

Each image forming portion P is located at a transfer contact position (latent image forming position) in the apparatus main assembly 100A. The transfer contact position means a position at which the drum 1 and the belt 13 contact each other and at which a latent image can be formed on the drum 1. At this transfer contact position, a driving force input portion 41 (FIG. 7) of the image forming portion P is in engagement with a driving force output portion (not shown) of the apparatus main assembly 100A. By a driving force transmitted from the driving force output portion to the driving force input portion 41, the drum 1 is rotationally driven in a counterclockwise direction indicated by an arrow at a predetermined speed. Further, by the transmission of the driving force to the driving force input portion 41, each of the developing roller 52 and the toner application roller 53 of the developing cartridge 3 is rotationally driven in a clockwise direction at a predetermined speed as shown in FIG. 3. To electrical contacts 42 and 43 (FIG. 7) provided correspondingly to each image forming portion P, an electric energy supplying system (not shown) of the apparatus main assembly 100A is electrically connected. As a result, application of a predetermined charging bias to the charging roller 2 at each image forming portion P and application of a predetermined developing bias to the developing roller 52 are performed through predetermined electric circuits (not shown).

An operation for forming a full-color image is as follows. On the basis of a print start signal, the drum 1 of each of the first to fourth image forming portions PY, PM, PC and PK is rotationally driven at the predetermined speed in the counterclockwise direction indicated by the arrow. Further, the belt 13 is rotationally driven in the clockwise direction indicated by an arrow (the (normal) rotational direction of the drum 1) at a speed which corresponds to the speed of the drum 1. The scanner unit 11 is also driven. In synchronization with the driving of the scanner unit 11, the charging roller 2 in each image forming portion P uniformly electrically charges the surface of the drum 1 to predetermined polarity and potential with a predetermined timing. The scanner unit 11 scans (exposes) the surface of each drum 1 with the beam of laser light L modulated correspondingly to the picture (image) signal for an associated colors. As a result, an electrostatic latent image corresponding to the picture signal for the associated color is formed on the surface of the drum 1. This electrostatic latent image is developed by the developing cartridge 3 into a toner image. To each of the primary transfer roller 17, a predetermined primary transfer bias is applied with predetermined control timing.

Through the above described electrophotographic image forming process operation, a yellow toner image, which corresponds to the yellow color component of a full-color image is formed on the drum 1 of the first image forming portion PY. This yellow toner image is primary-transferred onto the belt 13 by the primary transfer bias and primary transfer pressure.

On the drum 1 of the second image forming portion PM, a magenta toner image, which corresponds to the magenta component of the full-color image is formed, and this toner image is primary-transferred onto the belt 13 by the primary transfer bias and primary transfer pressure so that it is superposed on the yellow toner image which has already been transferred on the belt 13.

On the drum 1 of the third image forming portion PC, a cyan toner image, which corresponds to the cyan component of the full-color image, is formed and this toner image is primary-transferred onto the belt 13 by the primary transfer bias and primary transfer pressure so that it is superposed on the yellow and magenta toner images which have already been transferred the belt 13.

On the drum 1 of the fourth image forming portion PK, a black toner image, which corresponds to the black component of the full-color image, is formed and this toner image is primary-transferred onto the belt 13 by the primary transfer bias and primary transfer pressure so that it is superposed on the yellow, magenta, and cyan toner images which have already been transferred on the belt 13.

Consequently, an unfixed full-color toner image is synthetically formed on the belt 13 by the yellow, magenta, cyan and black toner images.

In this embodiment, after the primary transfer of the toner images onto the belt 13, the untransferred toner remaining on the surface of the drum 1 at each image forming portion P is subjected to simultaneous development and cleaning by the developing cartridge 3.

Meanwhile, the sheet feeding roller 20 is driven with a predetermined timing. Sheets S stacked on the sheet cassette 19 are separated and fed one by one by cooperation of the sheet feeding roller 20 and the separation roller 20*a*. As a result, the sheet S is introduced into a nip (secondary transfer nip) between the secondary transfer roller 22 and belt 13 with predetermined control timing. To the secondary transfer roller 22, a predetermined secondary transfer bias is applied with predetermined control timing. During nip-conveyance of the sheet S, superposed four color toner images are simultaneously secondary-transferred onto the sheet S by the secondary transfer bias and secondary transfer pressure.

The sheet S is separated from the surface of the belt 13 and introduced into the fixing device 23, and is subjected to heat and pressure in a fixation nip of the fixing device 23. As a result, color mixing of the respective color toner images and fixation thereof on the sheet S are performed. Thereafter, the sheet S is moved out of the fixing device 23, and then, is discharged as a full-color image formation product onto the sheet discharge portion 25 by the discharge roller pair 24.

After the separation of the sheet P from the belt 13, secondary-transfer residual toner remaining on the surface of the belt 13 is removed by a belt cleaning device 26.

(Maintenance)

Maintenance includes an exchanging operation of the developing cartridge 3, a toner filling operation of the developing cartridge 3, a maintenance check operation at each image forming portion P, and the like. In the following, the exchanging operation will be described as an example.

As the developing cartridge 3 at each image forming portion P is used for image formation, the toner stored in the developing cartridge 3 is consumed. Then, when the toner is consumed to such an extent that an image of a quality satisfactory to a user who has purchased the developing cartridge cannot be formed, the developing cartridge 3 is replaced with a fresh developing cartridge.

For this reason, e.g., the image forming apparatus is provided with a means (not shown) for detecting an amount of the toner remaining in each developing cartridge 3. The detected amount of the toner in each developing cartridge is compared, by the control circuit portion 200, with a threshold value preset for providing a prewarning or warning of its lifetime of the developing cartridge. When the detected amount of the residual toner in the developing cartridge is smaller than the preset threshold value, the prewarning or warning of its lifetime of the developing cartridge is displayed on a display portion (not shown). As a result, the image forming apparatus prompts the user to prepare a developing cartridge for exchange, or to replace the developing cartridge with a fresh developing cartridge, in order to maintain an output image quality.

In this embodiment, the exchange (replacement) of the developing cartridge 3 is performed through a method in which the image forming portion P including the developing cartridge 3 is placed on an image forming portion tray 35 as a pull-out type movable member and is replaced in a front-access manner. As a result, usability is improved.

On the front side of the apparatus main assembly 100A, an opening 30 through which the tray 35 (image forming portion P) passes when the image forming portion P is pushed in the inside of the apparatus main assembly 100A or is pulled out from the apparatus main assembly 100A is provided.

Further, on the front side of the apparatus main assembly 100A, a rotatable door 31 is provided. This door 31 is an opening/closing member locatable at a closing position for permitting closing the opening 30 and at an opening position for permitting opening the opening 30.

In this embodiment, at lower left and lower right portions of the door 31, horizontal (lateral) shafts 32 as hinges are provided.

Figure 4:
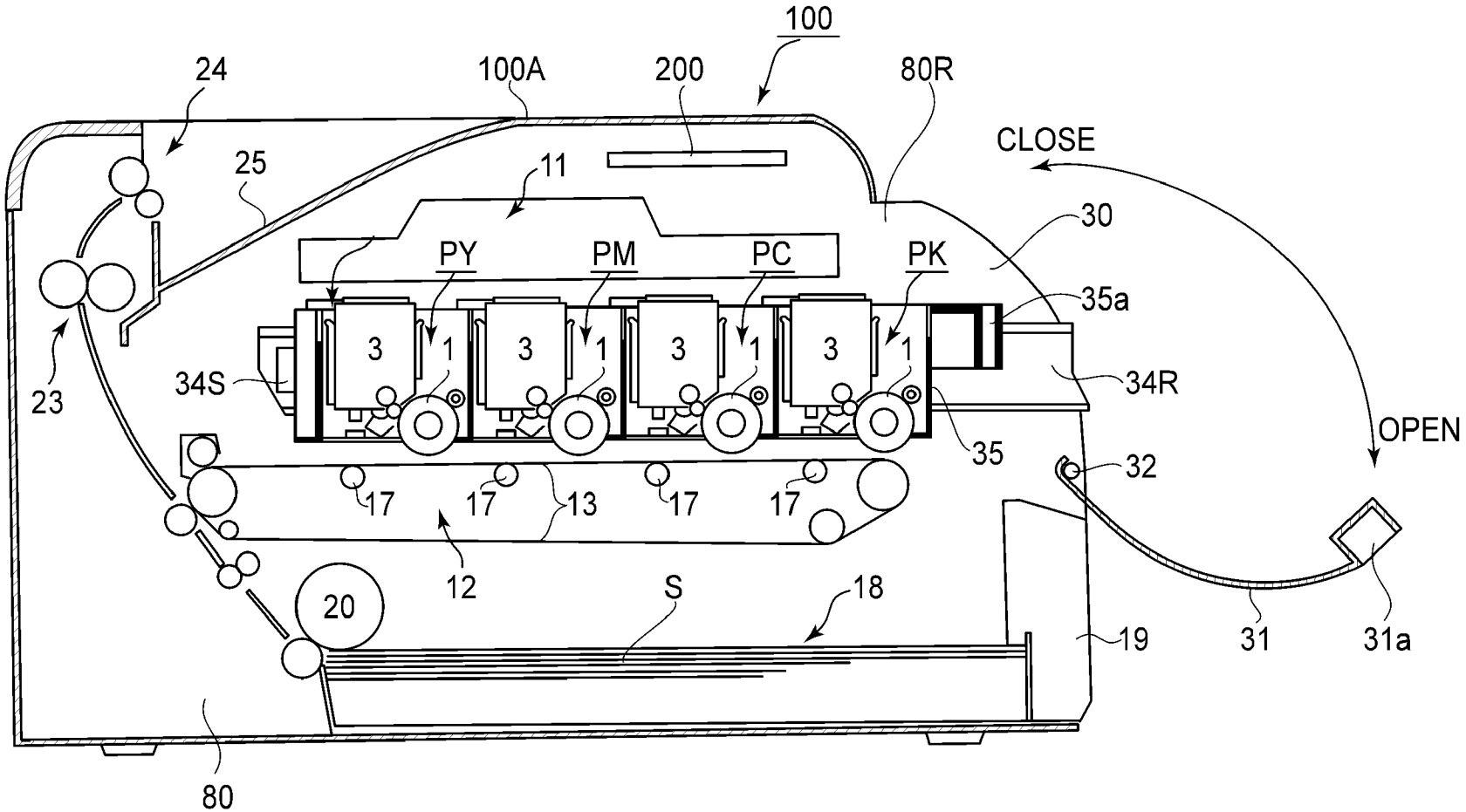
FIG. 4 is a longitudinal left side sectional view of the image forming apparatus in a state in which a front door is opened.

This door 31 can be rotationally moved relative to the apparatus main assembly 100A about the horizontal shafts 32. The door 31 is rotated about the horizontal shafts 32 so that it can be moved into the closed position (roughly vertical position) to close the opening 30 as shown in FIGS. 1 and 2, and also, so that it can be rotated frontward about the shaft 32 into the open position (roughly horizontal position), as shown in FIG. 4, to open the opening 30. To the door 31, a holding portion (finger placement portion) 31*a* for opening/closing the door 31 is provided.

Inside left and right frames 80L (not shown) and 80R of a main frame 80 of the apparatus main assembly 100A, a pair of left and right rail members 34 (34L (not shown) and 34R) are disposed, respectively. These rail members 34 oppose each other. A longitudinal (lengthwise) direction of each of the rail members 34 coincides with an front-rear direction of the apparatus main assembly 100A. Between the rail member 34, the image forming portion tray 35 as the movable member which is a frame member (hereinafter referred to as a toner) is disposed. This tray 35 is held by the rail members 34 so that the tray 35 can be horizontally slid in the front-rear direction of the apparatus main assembly 100A. On the tray 35, the first to fourth image forming portions PY, PM, PC and PK are mounted movably in a direction intersecting with the axial direction of the device 1 of each image forming portion P. Further, the developing cartridge 3 at each image forming portion P is detachably mounted to an associated developing cartridge mounting portion of the tray 35.

Figure 5:
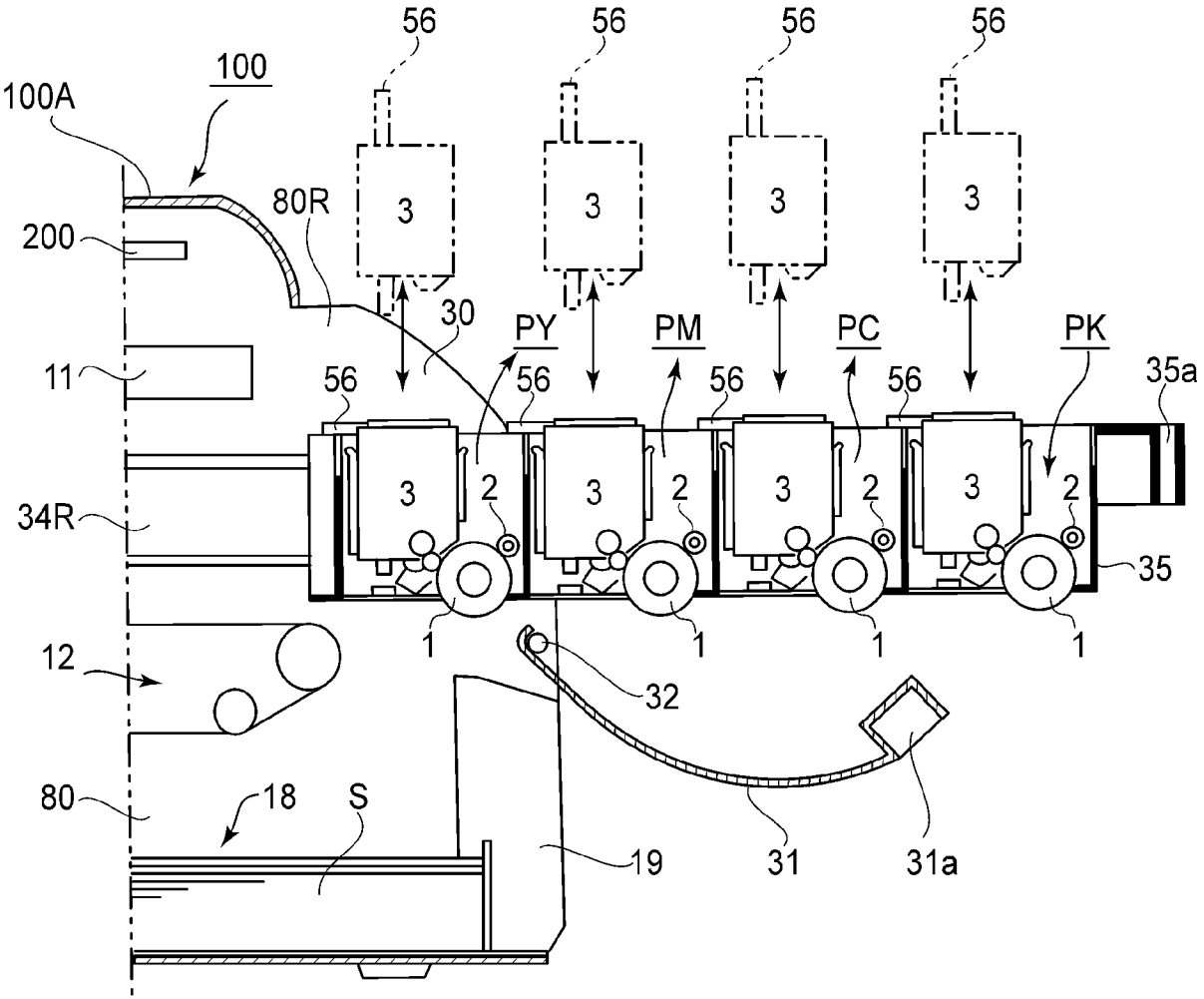
FIG. 5 is a partly sectional view of the image forming apparatus in a state in which a tray is moved to a pull-out position.

In interrelation with the opening of the door 31, the rail members 34 are moved both frontward and upward of the apparatus main assembly 100A by predetermined distances through an interrelating mechanism (not shown). That is, the rail members 34 are moved from a first position to a second position. Here, the first position is a position of the rail members 34 in which the tray 35 (image forming portion P) is moved to a transfer contact position (FIG. 2), and the second position is a position of the rail members 34 in which the tray 35 is moved between a push-in position (FIG. 4) and a pull-out position (FIG. 5). The push-in position is a position (inside position) at which the tray 35 is pushed in the inside of the apparatus main assembly 100A until the tray 35 runs against and is stopped by a stopper portion 34S provided to the rail members 34. The pull-out position is a position at which the tray 35 is pulled out to the outside of the apparatus main assembly 100A and the developing cartridges 3 at the image forming portions P are detachably mountable to the above-described mounting portions. The movement direction of the tray 35 intersects with the axial direction of the drum 1 of each image forming portion P. The rail members 34 are moved from the first position (FIG. 2) to the second position (FIG. 4), whereby front portions thereof are projected frontward by a predetermined distance.

In interrelation with the movement of the rail members 34 from the first position to the second position, drive output portions on the apparatus main assembly side are disengaged from corresponding drive input portions 41 of each image forming portion P (driven portion disengagement). Further, the positional fixation of the tray 35 by a positioning and fixing means (not shown) is unfixed. Further, electrical conduction of an electric energy supplying system on the apparatus main assembly 100A side to the electrical contacts 42 and 43 of each image forming portion P is ceased (electrical disconnection).

As described above, when the rail members 34 are moved from the first position to the second position, the tray 35 is moved upward together with the rail members 34, so that the drum 1 of each image forming portion P is separated from the belt 13. That is, the tray 35 is moved from the transfer contact position in which the drum 1 and the belt 13 contact each other to the transfer separation position (push-in position) in which the drum 1 and the belt 13 are separated from each other.

Next, the tray 35 is moved along the rail members 34 while gripping a grip portion (finger placement portion) 35*a* provided on the front side of the tray 35, so that the tray 35 is sufficiently pulled out from the inside to the outside of the apparatus main assembly 100A.

As a result, the entire four image forming portions P held by the tray 35 pass through the opening 30 and are pulled out to the outside of the apparatus main assembly 100A as shown in FIG. 5. That is, the tray 35 is moved from the push-in position to the pull-out position. Thus, upper (top) surfaces of all the image forming portions P are exposed.

When the tray 35 is pulled out by a preset predetermined distance, it is prevented by an unshown stopper portion from being pulled out further. The tray 35 is held in this horizontally pulled out state by the rail members 34. In this pull-out movement of the tray 35, the drum 1 of each image forming portion P and the belt 13 are separated from each other, so that friction therebetween is not caused to occur.

The tray 35 supports the developing cartridge 3 at each image forming portion P so as to be detachably movable directly above. As shown by chain double-dashed lines in FIG. 5, a developing cartridge 3 to be replaced is raised and removed above from the mounting portion of the tray 35. In this case, the user raises and rotates a grip portion 56 which is provided on the upper surface side of the developing cartridge 3 and is placed in a state in which it is laid on its side at the rear side of the developing cartridge 3. Then, by gripping the grip portion 56 and raising the developing cartridge 3 to detach right above from the mounting portion of the tray 35. Thereafter, by holding a fresh developing cartridge 3 while similarly gripping the grip portion 56, the fresh developing cartridge 3 is placed on the mounting portion of the tray 35 from above the tray 35. Then, the grip portion 56 is inclined and rotated toward the rear side of the developing cartridge 3. As a result, the developing cartridge 3 is mounted to the mounting portion of the tray 35. Thereafter, the tray 35 is moved from the pull-out position (FIGS. 4 and 5) to the push-in position (FIG. 3) and then the door 31 is closed.

In interrelation with the closing of the door 31, the rail members 34 are moved from the second position to the first position through the interrelating mechanism. As a result, the tray 35 is moved from the push-in position to the transfer contact portion. Further, in interrelation with the movement of the rail members 34, the drive output portion on the apparatus main assembly side are connected to the drive input portions 41 of each image forming portion P. Further, to the electrical contacts 42 and 43, the energy supplying system on the apparatus main assembly 100A side is electrically connected. Further, the tray 35 is positioned and fixed by the positioning and fixing means. As a result, the image forming apparatus is placed in a state in which the image forming operation can be performed.

In summary, the tray 35 is the movable member provided movably in the direction intersecting with the axial direction of the drum 1 of each image forming portion P. Further, the tray 35 passes through the opening 30 and is movable to the pull-out position (outside position) in which the tray 35 is pulled out to the outside of the apparatus main assembly 100A while supporting each image forming apparatus P including the drum 1 and the developing cartridge 3. In this pull-out position, the developing cartridge 3 is detachably mountable to an associated mounting portion of the image forming portion P. Further, the tray 35 is movable to the push-in position (inside position) in which the image forming portions each including the drum 1 and the developing cartridge 3 are pushed into the inside of the apparatus main assembly 100A. The tray 35 can take the mounting position in which each image forming portion P is mountable inside the apparatus main assembly 100A and the transfer contact position in which the drum 1 is contactable to the belt 13 (a latent image forming position in which the latent image is formable on the drum 1). The left and right tray holding (rail) members 34L and 34R are movable means for moving the tray 35 from the mounting position in the upward direction before the tray 35 as the movable member is moved to the pull-out position in which the developing cartridge 3 of each image forming portion P is detachably mountable. Alternatively, the holding members 34L and 34R are movable means for moving the tray 35 toward the mounting portion in the downward direction. In other words, the holding members 34L and 34R are a supporting member for supporting the tray 35 and can take the first position in which the tray 35 is movable between the pull-out position and the mounting position and can take the second position in which the tray 35 is locatable at the latent image forming position. Further, in interrelation with the closing the door 31, the holding members 34L and 34R are moved from the first position to the second position.

(Tray 35)

Figure 6:
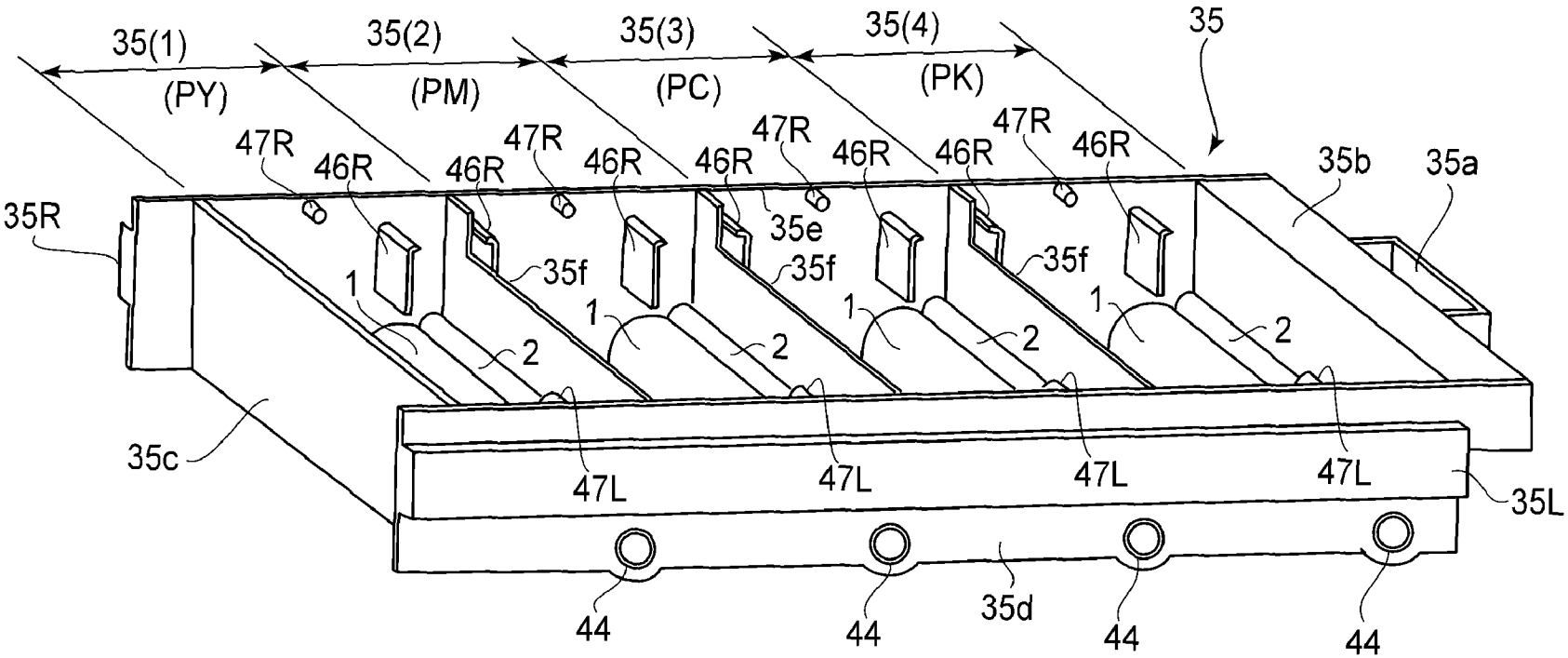
FIG. 6 is a perspective view of an outer appearance of the tray, from which developing cartridges are demounted from associated image forming portions, as seen from a non-driving side (left side).
Figure 7:
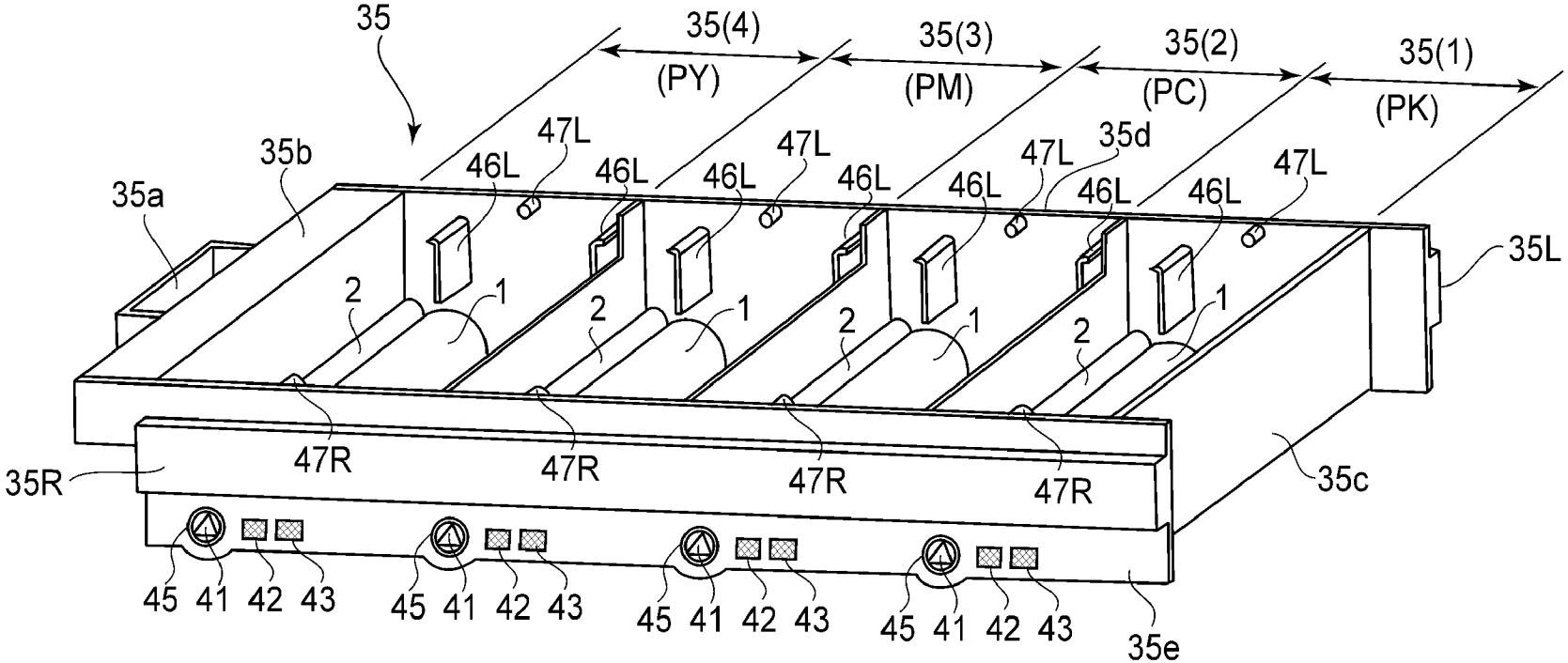
FIG. 7 is a perspective view of the outer appearance of the tray as seen from a driving side (right side).

A constitution of the tray 35 will be described with reference to FIGS. 6 and 7. FIG. 6 is a perspective view of an outer appearance of the tray 35, in a state in which the developing cartridges 3 are demounted from the respective image forming portions P, as seen from a non-driving side (left side) of the tray 35. FIG. 7 is a perspective view of the outer appearance of the tray 35 as seen from a driving side (right side) of the tray 35.

The tray 35 includes a rectangular frame portion prepared by connecting a front frame plate 35*b*, a rear frame plate 35*c*, a left frame plate 35*d*, and a right frame plate 35*e*. The left frame plate 35*d* side of the tray 35 is the non-driving side and the right frame plate 35*e* side is the driving side.

The inside of the frame work portion is substantially equal partitioned into four areas by three partitioning plates 35*f* with respect to the front-rear direction of the framework portion, so that first to fourth small frame portions 35(1) to 35(4) from the rear frame plate 35*c* side to the front frame plate 35*b* side are formed in this order. Each of the small frame portions 35(1) to 35(4) is an elongated frame portion extending in the left-right direction as a longitudinal direction thereof. The small frame portions 35(1), 35(2), 35(3) and 35(4) are constituted as the first to fourth image forming portions PY, PM, PC and PK, respectively. That is, at each of the small frame portions 35(1) to 35(4), the drum 1 is rotatably disposed through shaft-supporting members 44 and 45 between the left frame plate 35*d* and the right frame plate 35*e* with the drum shaft (axis) extending in the left-right direction. On the shaft-supporting member 45 side, a driving force input coupling as the driving force input portion 41 is provided. Further, the charging roller 2 is rotatably disposed through shaft-supporting members (not shown) between the left frame plate 35*d* and the right frame plate 35*e* with a roller shaft (axis) line substantially in parallel to the drum shaft (axis) line and in contact with the drum 1 with a predetermined urging force. On inner surfaces of the left frame plate 35*d* and the right frame plate 35*e* at each of the small frame portions 35(1) to 35(4), a pair of guide plates 46L and 46R and another pair of guide plates 46L and 46R which are configured to vertically guide an associated developing cartridge 3 detachably mountable to the mounting portion are disposed in a bilaterally-symmetric manner. Further, a pair of locking pins (portions to be engaged or locking members) 47L and 47R are also provided. At each of the small frame portions 35(1) to 35(4), an area defined by the pair of guide plates 46L and 46R and another pair of guide plates 46L and 46R is the developing cartridge mounting portion. A left end side and a right end side of the developing cartridge 3 are engaged between the two pairs of guide plates 46L, 46R, 46L and 46R, so that the developing cartridge 3 is moved and guided detachably mountable in the vertical direction.

On an outside surface of the right frame plate 35*e* which is the driving side of the tray 35, the electrical contacts 42 and 43 are provided correspondingly to each of the first to fourth image forming portions PY, PM, PC and PK. Further, on the outside surfaces of the left frame plate 35*d* and the right frame plate 35*e*, elongated projection portion 35L and 35R extending in the front-rear direction are provided. The projection portion 35L on the left frame plate 35*d* is engaged with a recessed groove portion which is provided at an inner surface of the left rail member 34L (not shown) on the apparatus main assembly 100A side and extends in the front-rear direction. Further, the projection portion 35R on the right frame plate 35*e* is engaged with a recessed groove portion which is provided at an inner surface of the right rail member 34R on the apparatus main assembly 100A side and extends in the front-rear direction. As a result, the tray 35 is slidably supported in the front-rear direction between the left and right rail members 34L and 34R.

(Developing Cartridge 3)

Figure 8:
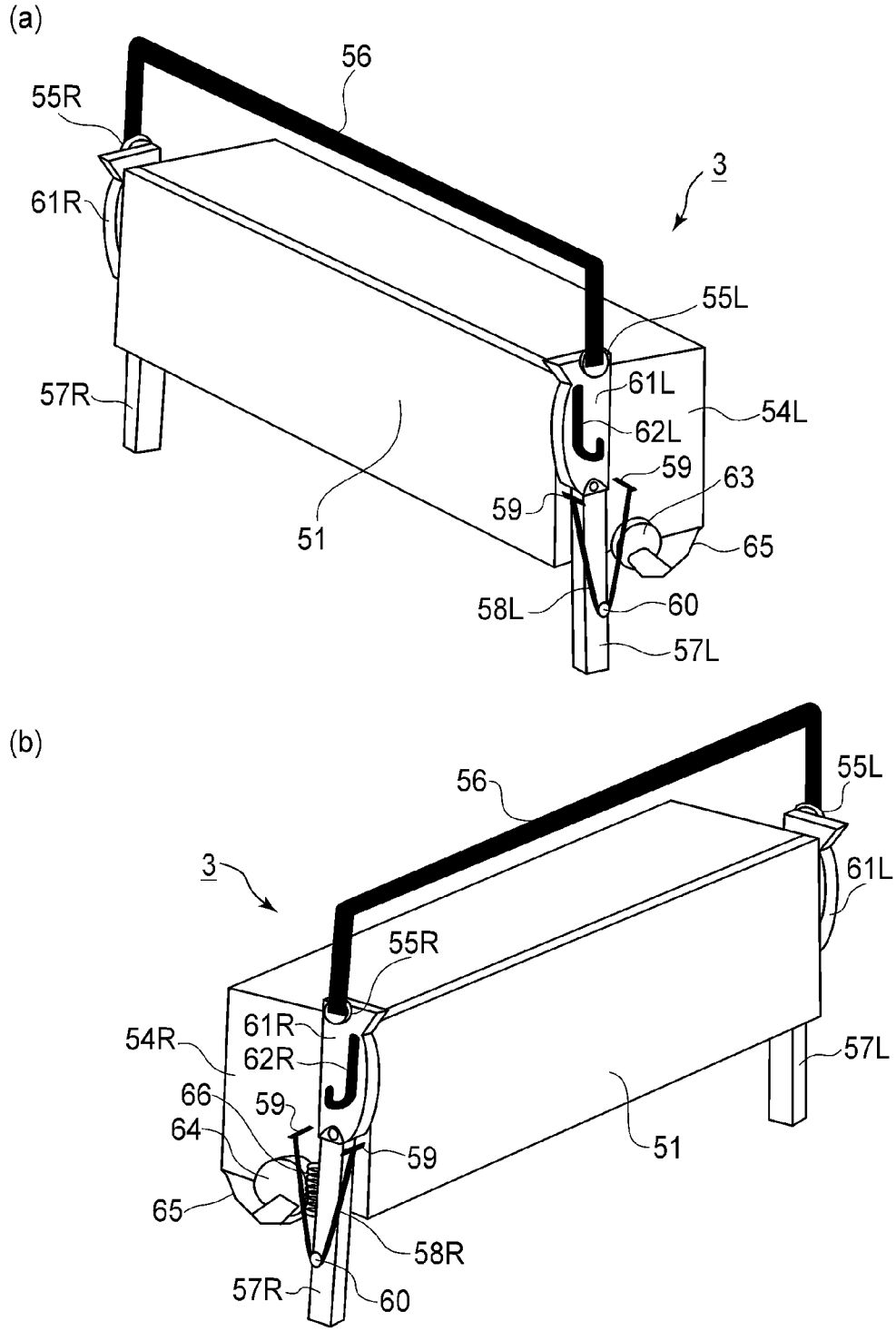
FIG. 8(*a*) is a perspective view of the developing cartridge with a standing grip portion as seen from the non-driving side (left side) and FIG. 8(*b*) is a perspective view of the developing cartridge with the standing grip portion as seen from the driving side (right side).

The developing cartridges 3 of the respective image forming portions P have the same constitution except that the colors of toners contained in the developing cartridges 3 are different from each other. FIG. 8(*a*) is a perspective view of a developing cartridge 3 before being mounted to the tray 35 as seen from the non-driving side (left side). FIG. 8(*b*) is a perspective view of the developing cartridge 3 as seen from the driving side (right side).

The developing cartridge 3 includes an elongated toner container (developing container) 51 extending in the left-right direction as a longitudinal direction. In the toner container 51, the toner (not shown) is contained in a predetermined amount. At a lower portion of the toner container 51, as shown in FIG. 3, the developing roller 52 as a developer carrying member (developing member or developer supplying member) for developing the latent image into the toner image by supplying the toner to the drum 1 is disposed. Further, the toner application roller 53 as a toner application member for applying the toner to the developing roller 52 is disposed. The developing roller 52 and the toner application roller 53 are rotatably supported and disposed through shaft-supporting members (not shown) between left and right side plates 54L and 54R of the toner container 51. The toner application roller 53 is disposed in parallel to the developing roller 52 and in contact with the developing roller 52 with a predetermined urging force. The developing roller 52 is exposed toward the outside of the toner container 51 at a surface, opposite from a surface facing the toner application roller 53, as an opposing surface at which the developing roller 52 opposes the drum 1. The developing roller 52 and the toner application roller 53 are rotationally driven in the clockwise direction at the predetermined speed as shown in FIG. 3 through a power transmitting mechanism (not shown) by which a driving force is transmitted from the driving force output portion to the driving force input portion 41 in a state in which the image forming portion P is located at the transfer contact position.

Figure 9:
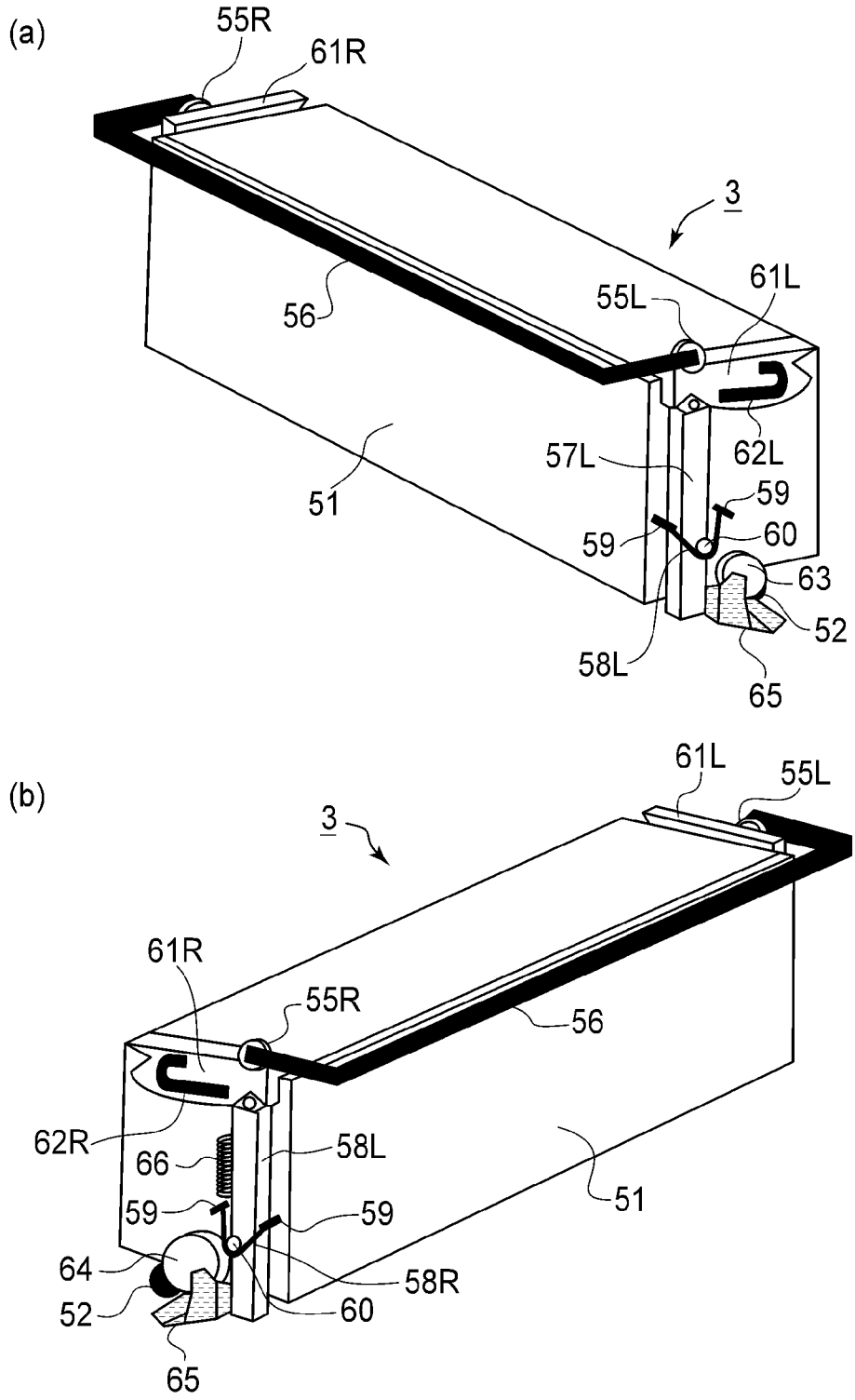
FIG. 9(*a*) is a perspective view of the developing cartridge with the grip portion laid on its side as seen from the non-driving side (left side) and FIG. 9(*b*) is a perspective view of the developing cartridge with the grip portion laid on its side as seen from the driving side (right side).

On the upper side of the toner container 51, an elongated portal-shaped grip portion 56 is provided between a hinge shaft 55L provided at an upper portion of the left side plate 54L and a hinge shaft 55R provided at an upper portion of the right side plate 54R. The grip portion 56 can be rotationally moved about the hinge shafts 55L and 55R in a direction in which the grip portion 56 is raised from the upper surface of the toner container 51. The raised (erected) position is a first rotation angle position. Further, as shown in FIGS. 9(*a*) and 9(*b*), the grip portion 56 can be rotationally moved so as to be laid on its side at the rear side of the developing cartridge 3. The laid position is a second rotation angle portion. That is, the grip portion 56 is provided movably between the first rotation angle portion and the second rotation angle portion.

On the other surfaces of the left and right side plates 54L and 54R of the toner container 51, a pair of left and right spacing (separating) rods (shifting members) 57L and 57R each extending in the vertical direction as the longitudinal direction is provided. These left and right spacing rods 57L and 57R are provided slidably movable on the outer surfaces of the left and right side plates 54L and 54R in the vertical direction by, e.g., a dovetail groove engaging structure (not shown) extending in the vertical direction. The left and right spacing rods 57L and 57R are upwardly moved and urged by urging members 58L and 58R. In this embodiment, as the urging members 58L and 58R, a string-like elastic member such as a rubber string or an elongated coil spring is used. Both end portions of the string-like elastic member are fixed to pins 59 provided on each of the outer surfaces of the left and right side plates 54L and 54R and an intermediate portion is stretched and hooked, against elasticity, on a pin 60 provided on each of the spacing rods 57L and 57R. Therefore, the left and right spacing rods 57L and 57R are always moved and urged upward by a stretching reaction force of the urging members 58L and 58R. At both end portions on the left and right sides of the grip portion 56, a pair of left and right spacing cams 61L and 61R is provided integrally with the grip portion 56. When the grip portion 56 is rotationally moved about the hinge shafts 55L and 55R, the left and right spacing cams 61L and 61R are rotationally moved about the hinge shafts 55L and 55R together with the grip portion 56. The upper end portions of the left and right spacing rods 57L and 57R moved and urged upwardly by the urging members 58L and 58R runs against and are stopped by cam surfaces (profiles) of the left and right spacing cams 61L and 61R. Further, locking arms (engaging members) 62L and 62R are provided on the outer surfaces of the left and right spacing cams 61L and 61R, respectively. At lower portions of the outer surfaces of the left and right side plates 54L and 54R of the toner container 51, a left rotatable member 63 and a right rotatable member 64 are coaxially provided. Between the left rotatable member 63 and the right rotatable member 64, a shutter 65 as a developing portion protecting member is provided. The shutter 65 is rotatable about the left and right rotatable members 63 and 64, at the lower portion of the toner container 51, between a closing position in which the shutter 65 covers and protects the developing roller 52 and an opening position in which the shutter 65 is retracted from the closing position in which the shutter 65 covers the developing roller 52. Further, the shutter 65 is rotationally urged in a direction, in which the shutter 65 is opened and rotationally moved, by an urging member (not shown). The right rotatable member 64 is a pinion gear. The right spacing cam 61R is provided with a rack portion with respect to the pinion gear 64.

As shown in FIGS. 8(*a*) and 8(*b*), when the grip portion 56 is rotationally moved in the standing (erected) state, the left and right spacing cams 61L and 61R are in a rotationally movement state such that the cam surfaces of the elongated portions thereof are directed downwardly. For that reason, the left and right spacing rods 57L and 57R are placed in a state in which they are moved downwardly at a maximum level against the elasticity of the urging members 58L and 58R. At this time, the upper end portions of the left and right spacing rods 57L and 57R are engaged in and stopped by recessed groove portions provided to the downwardly directed cam surfaces of the elongated portions of the left and right spacing cams 61L and 61R. That is, the left and right spacing cams are placed in a click-stop state. In this click-stop state, the grip portion is stably held in the standing state. Further, the lower end portions of the left and right spacing rods 57L and 57R are placed in a state in which they are considerably projected downwardly from the lower surface of the toner container 51 by a predetermined length.

When the grip portion 56 is rotationally moved in the standing state, the pinion gear 64 is rotated in the shutter closing direction by the rack portion 66 provided to the right spacing rod 57R, so that the shutter 65 is held at the predetermined closing position in which the shutter 65 covers the developing roller 52.

With respect to the developing cartridge 3 in the state shown in FIGS. 8(*a*) and 8(*b*), when the grip portion 56 is rotationally moved in the direction in which the grip portion 56 is laid on its side toward the rear side of the developing cartridge 3 as shown in FIGS. 9(*a*) and 9(*b*), the left and right spacing cams 61L and 61R are placed in a state in which the elongated portions are horizontally directed so that another recessed groove portion is directed downwardly. For this reason, the left and right spacing rods 57L and 57R are placed in a state in which they are moved upwardly at a maximum level by the stretching reaction force of the urging members 58L and 58R. At this time, the upper end portions of the left and right spacing rods 57L and 57R are engaged in and stopped by the downwardly directed another recessed groove portion at the cam surfaces of the left and right spacing cams 61L and 61R. That is, the left and right spacing cams 61L and 61R are in the click-stop state, in which the laid (sideway) state of the grip portion 56 is stably held. Further, when the grip portion 56 is rotationally moved in the laid state, the pinion gear 64 is rotationally moved in the shutter opening direction by the rack portion 66 provided to the right spacing rod 57R and the rack portion 66 is moved to a position away from the pinion gear 64. As a result, the shutter 65 is held in the state in which the shutter is opened and rotationally moved about the left and right rotatable members 43 and 44 to the opening position by the urging member, so that the developing roller 52 is in a state in which it is exposed to the outside.

As described above, the shutter 65 is moved to the opening position in which it is retracted from the developing roller 52 in the state in which the grip portion 56 is laid on its side and is moved to the closing position in which it covers the developing roller 52 in the standing state of the grip portion 56. Each of the left and right spacing cams 61L and 61R is provided with the two recessed groove portions at its elongated portion. Each of the two recessed groove portions is engaged with the upper end portion of the spacing rod 57L or 57R, thus having the function of stably keeping the standing position and the laid position of the grip portion 56. That is, the recessed groove portion provided to the elongated portion and the upper end portion of the spacing cam 61L or 61R function as a holding means for stably holding the grip portion 56 in the standing state at the first rotation angle position. Further, another recessed groove portion provided to the elongated portion and the upper end portion of the spacing cam 61L and 61R function as a holding means for stably holding the grip portion 56 in the laid state at the second rotation angle position.

Next, a manner of mounting the developing cartridge 3 to the developing cartridge 3 will be described with reference to FIGS. 10(*a*), 10(*b*), 11(*a*) and 11(*b*).

Figure 10:
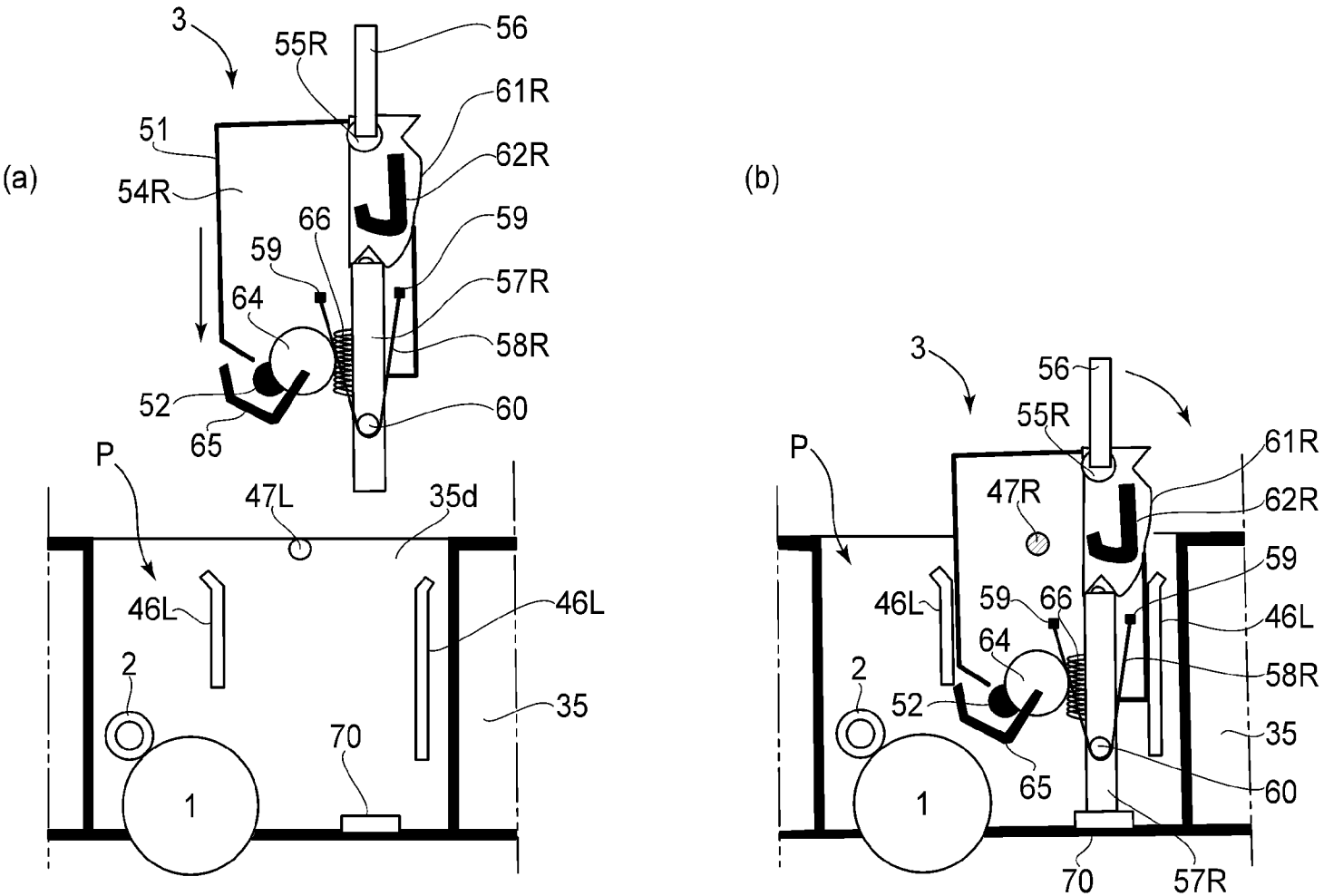
FIGS. 10(*a*), 10(*b*), 11(*a*) and 11(*b*) are schematic views for illustrating a mounting process of the developing cartridge with respect to the tray.

(1) As shown in FIG. 10(*a*), the user grips and holds the grip portion 56 of the developing cartridge 3 rotationally moved in the standing state and inserts the developing cartridge 3 from above into the developing cartridge mounting portion of an associated image forming portion P of the tray 35 pulled out to the pull-out position. Specifically, the left and right sides of the developing cartridge 3 are engaged between the two pairs of the guide plates 46L and 46L and 46R and 46R. Then, the developing cartridge 3 is inserted downwardly along the guide plates 46L, 46L, 46R and 46R. As described above, the shutter 65 of the developing cartridge 3 is kept at the predetermined closing position in which it covers the developing roller 52 when the grip portion 56 is in the standing state. Further, the lower end portions of the left and right spacing rods 57L and 57R are considerably projected downwardly from the lower surface of the toner container 51 by the predetermined length.

(2) Then, as shown in FIG. 10(*b*), during the insertion movement of the developing cartridge 3 toward the mounting portion, each of the lower end surfaces of the left and right spacing rods 57L and 57R runs against and is stopped by a spacing rod contact portion 70 on the tray 35 side. As a result, the developing cartridge 3 is prevented from being further inserted toward the mounting portion. In this state, the shutter 65 (the developing roller 52) is located at a separation position in which it is located above and apart from the drum 1 with a predetermined spacing.

Figure 11:
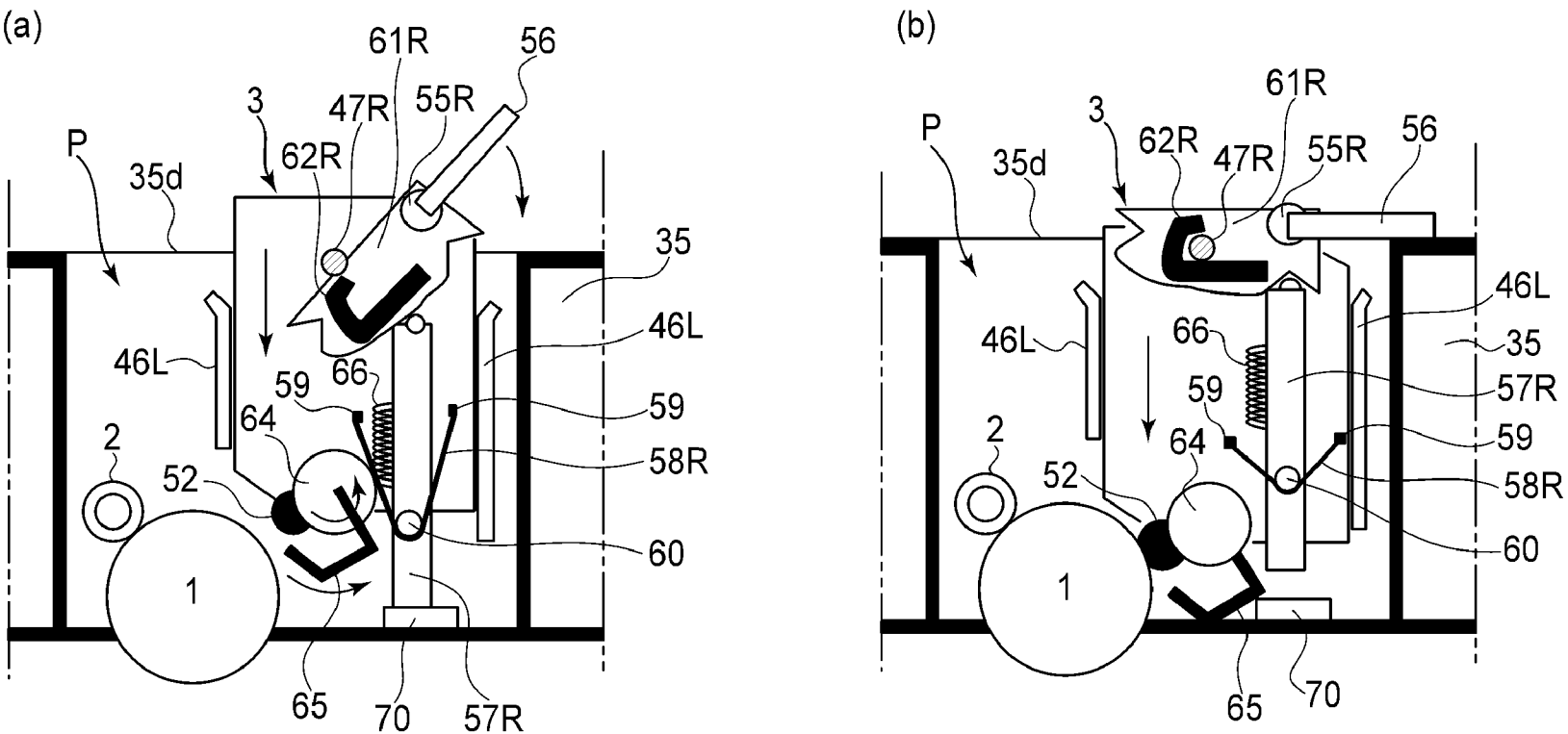

(3) Next, as shown in FIGS. 11(*a*) and 11(*b*), the grip portion 56 in the standing state is rotated and laid on its side toward the rear side of the developing cartridge 3. In this rotationally laying process of the grip portion 56, contact portions between the cam surfaces of the left and right spacing cams 61L and 61R and the upper end portions of the left and right spacing rods 57L and 57R are moved from the recessed groove portion side toward another recessed groove portion side. Correspondingly, the toner container 51 is moved and lowered into the mounting portion along the guide plates 46L, 46L, 46R and 46R and the spacing rods 57L and 57R by its own weight and the stretching reaction force.

(4) During this downward movement process of the toner container 51, the pinion gear 64 is rotated in the counterclockwise direction indicated by an arrow in FIG. 11(*a*) by the rack portion 66 provided to the right spacing rod 57R. That is, the shutter 65 is rotated in the opening direction to be moved to the opening position in which the shutter 65 comes out of the spacing between the drum 1 and the developing roller 52 without contacting the drum 1, so that the developing roller 52 is placed in an exposed state.

(5) Then, by further downward movement of the toner container 51, the developing roller 52 contacts the drum 1. Alternatively, spacer rollers (not shown) provided at both left and right end portions of the developing roller 52 contact both left and right end portions of the drum 1, so that the developing roller 51 operably opposes the drum 1 with a predetermined gap. That is, the developing roller 52 is located at a operable position in which the developing roller 52 opposes the drum 1 in a operable state. By the contact of the developing roller 52 or the spacer rollers with the drum 1, the further downward movement of the toner container 51 is stopped.

Until this time, the pinion gear 64 passes through the lower end portion of the rack portion 66 and is moved away from the rack portion 66. Further, the shutter 65 is held by the urging member in the state in which it is opened and rotated about the left and right rotatable members 43 and 44 to the predetermined opening position.

(6) The stop of the downward movement of the toner container 51 is performed at the time before the grip portion 56 is completely rotated and laid on its side. Thereafter, the grip portion 56 is rotated and laid on its side completely.

(7) On the other hand, corresponding to the rotational movement of the left and right spacing cams 61L and 61R by the rotational movement of the grip portion 56, the left and right locking arms 62L and 62R of the developing cartridge 3 are gradually engaged from below to the left and right locking pins 47L and 47R of the tray 35. Then, when the grip portion 56 is completely rotated and laid on its side, as shown in FIG. 11(*b*), the locking arms 62L and 62R are completely engaged with the locking pins 47L and 47R.

(8) The spacing rods 57L and 57R is upwardly moved with respect to the toner container 51 by the stretching reaction force of the urging members 58L and 58R. Then, the upper end portions of the spacing rods 57L and 57R are engaged in and stopped by the finally downwardly directed another recessed groove portion of the elongated portions of the cam surfaces of the left and right spacing cams 61L and 61R. As a result, the left and right spacing cams 61L and 61R are placed in the click-stop state, the grip portion 56 is stably held in the laid state. By the upward movement of the spacing rods 57L and 57R, the lower end portion surfaces of the spacing rods 57L and 57R are separated from the spacing rod contact portion 70 of the tray 35.

(9) Further, by the engagement of the locking arms 62L and 62R with the locking pins 47L and 47R, the developing cartridge 3 cannot be pulled out from the tray 35 in the state in which the grip portion 56 is rotated and laid on its side.

The locking arms 62L and 62R are engaged with the locking pins 47L and 47R provided to the tray 35, thus having the function of fixing the developing cartridge 3 to the tray 35 to prevent the developing cartridge 3 from being demounted by the user.

The state shown in FIG. 11(*b*) is a state in which the developing cartridge 3 is mounted to the developing cartridge mounting portion of the image forming portion P of the tray 35 in a predetermined manner.

Demounting procedure and operation of the developing cartridge 3 are the reverse of the above-described mounting procedure and operation.

(10) That is, the grip portion 56 of the developing cartridge 3 placed in the mounted state in the tray 35 as shown in FIG. 11(*b*) is operated so as to be rotationally moved in the standing direction.

The contact portions between the came surfaces of the left and right spacing cams 61L and 61R and the upper end portions of the left and right spacing rods 57L and 57R are moved from the another recessed groove portion toward the recessed groove portion. Correspondingly, the left and right spacing rods 57L and 57R are downwardly moved with respect to the toner container 51 against the elasticity of the urging members 58L and 58R, so that the lower end portion surfaces of the spacing rods 57L and 57R run against and are stopped by the spacing rod contact portion 70 of the tray 35.

(11) Then, by the rotational movement of the spacing cams 61L and 61R following further rotational movement of the grip portion 56 in the standing direction, the toner container 51 is gradually moved upwardly along the guide plates 46L, 46L, 46R and 46R and the spacing rods 57L and 57R against its own weight and the elasticity of the urging members 58L and 58R. By this upward movement of the toner container 51, the developing roller 52 is upwardly moved away from the drum 1. When the developing roller 52 is moved away from the drum 1 by a predetermined distance, the pinion gear 64 starts engagement with the rack portion 66 provided to the right spacing rod 57R. As a result, the pinion gear 64 is rotationally moved in a clockwise direction opposite from the (counterclockwise) direction indicated by the arrow in FIG. 11(*a*) correspondingly to further upward movement of the toner container 51. That is, the shutter 65 is rotationally moved in the closing direction against the urging member and enters the spacing between the drum 1 and the developing roller 52 without contacting the drum 1, thus being rotationally moved to the closing position in which the shutter 65 covers and protects the developing roller 52.

(12) The upward movement of the toner container 51 is performed until the recessed groove portions of the elongated portions of the cam surfaces of the left and right spacing cams 61L and 61R are directed downwardly and engaged with the upper end portions of the left and right spacing rods 57L and 57R by the rotational movement of the grip portion 56 performed until the grip portion 56 is finally placed in the vertical standing state. During this upward movement process of the toner container 51, the pinion gear 64 is engaged with the rack portion 66 to be rotated in the shutter closing direction, so that the shutter 65 is finally rotationally moved to the predetermined closing position. That is, the developing cartridge 3 is placed in the state shown in FIG. 10(*b*).

(13) On the other hand, corresponding to the rotational movement of the left and right spacing cams 61L and 61R by the rotational movement of the grip portion 56, the left and right locking arms 62L and 62R of the developing cartridge 3 are gradually disengaged from the left and right locking pins 47L and 47R of the tray 35. Then, when the grip portion 56 is completely rotated and raised upright, as shown in FIG. 10(*b*), the locking arms 62L and 62R are completely disengaged from the locking pins 47L and 47R.

(14) Since the engagement of the locking arms 62L and 64R with the locking pins 47L and 47R is released, the user can demount the developing cartridge 2 right above from the mounting portion of the tray 35 by raising the developing cartridge 3 while gripping the grip portion 56.

At this time, the developing roller 52 is covered and protected with the shutter 65, so that the developing roller 52 is not damaged during the maintenance operation. Further, the developing roller 52 is covered with the shutter 65, so that a degree of scattering of the toner into the air during the maintenance can be alleviated.

Figure 12:
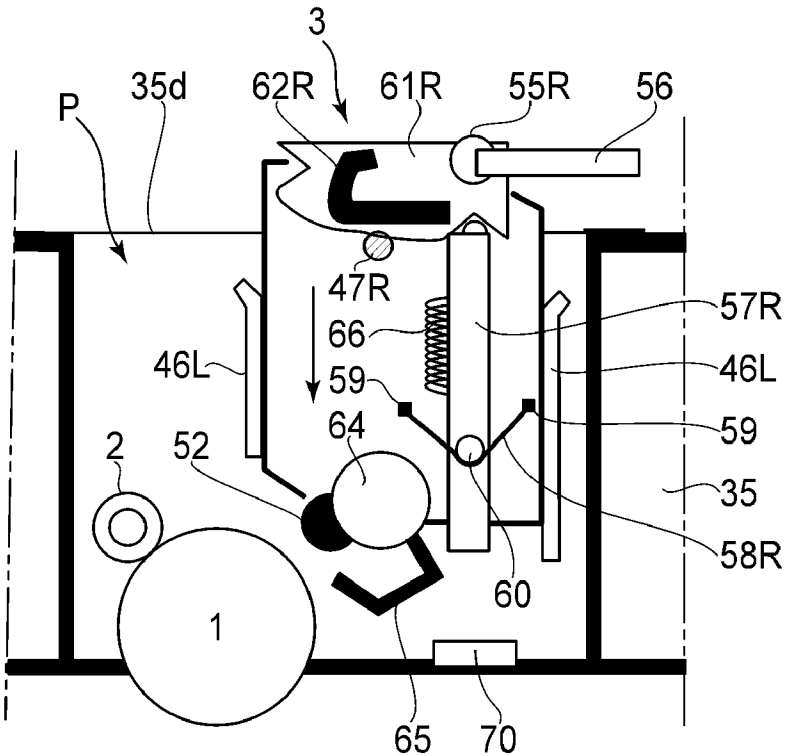
FIG. 12 is a schematic view showing a state in which a developing cartridge-side locking arm and a tray-side locking pin interfere with each other when the developing cartridge is mounted to a mounting portion of the tray in a state in which the grip portion is laid on its side.

When the user who has completed the maintenance intends to mount the developing cartridge 3 to the mounting portion in a state in which the grip portion 56 is laid on its side as shown in FIG. 12, the locking arms 62L and 62R of the developing cartridge 3 interfere with the locking pins 47L and 47R of the tray 35. As a result, it is possible to prevent the developing cartridge 3 from being mounted to the tray 35 in a state in which the developing roller 52 is not protected with the shutter 65 by the closing movement of the shutter 65.

As described above, the developing roller 52 can be protected from the outside by the shutter 65 during the mounting and demounting operation of the developing cartridge 3 and it is also possible to prevent the damage of the developing cartridge 3 and to alleviate the degree of scattering of the toner contained in the developing cartridge 3, so that usability can be improved.

The locking arms 62L and 62R and the locking pins 47L and 47R are provide at outermost longitudinal portions with respect to the developing cartridge 3. For that reason, in the mounting and demounting operation of the developing cartridge 3, parts of the developing cartridge 3 except the locking arms 62L and 62R do not contact the locking pins 47L and 47R.

In summary, the developing cartridge 3 includes the following portions or members.

The developing cartridge includes the grip portion 56 provided rotatably movable between the first rotation angle position (the standing position) and the second rotation angle position (the laid portion).

The developing cartridge 3 also includes the developing portion protecting member (the shutter) 65 provided movably between the closing position in which it covers the developer carrying member (the developing roller) 52 and the opening position in which the developer carrying member 52 is exposed.

The developing cartridge 3 further includes the shifting member (the spacing rod) 57 for shifting the developing cartridge 3 mounted to the mounting portion between the operable position in which the developer carrying member 52 opposes the image bearing member (the drum) 1 in a operable state and the separation position in which the developer carrying member is moved away from the image bearing member 1 by the predetermined distance.

The developing cartridge 3 further includes the interrelating members (the spacing cams, the rack portions and the pinion gears) 61, 66 and 64 operated in interrelation with the rotational movement operation of the grip portion 56. These interrelating members 61, 66 and 64 are operated, in the state in which the developing cartridge 3 is mounted to the mounting portion, in interrelation with the rotational movement operation of the grip portion 56 from the first rotation angle position to the second rotation angle position thereby, to move the developing portion protecting member 65 from the closing position to the opening position. Further, by the shifting member 57, the developing cartridge 3 is shifted from the separation position to the operable position. Further, the interrelating members 61, 66 and 64 are operated, in the state in which the developing cartridge 3 is mounted to the mounting portion, in interrelation with the rotational movement operation of the grip portion 56 from the second rotation angle position to the first rotation angle position thereby, to move the developing portion protecting member 65 from the opening position to the closing position. Further, by the shifting member 57, the developing cartridge 3 is shifted from the operable position to the separation position.

The interrelating members 61, 66 and 64 is operated, in interrelation with the rotational movement operation of the grip portion 56 from the first rotation angle position to the second rotation angle position, so that the developing cartridge 3 is shifted from the separation position to the operable position after the developing portion protecting member 65 is moved from the closing position to the opening position.

Further, the interrelating members 61, 66 and 64 is operated, in interrelation with the rotational movement operation of the grip portion 56 from the first rotation angle position to the second rotation angle position, so that the developing portion protecting member 65 is moved from the opening position to the closing position after the developing cartridge 3 is shifted from the operable position to the separation position.

The developing cartridge 3 further includes the engaging members (the locking arms) 62 which are operated in interrelation with the rotational movement operation of the grip portion 56 and are engaged with and disengaged from the portions to be engaged (the locking pins) 47 provided to the developing cartridge mounting portions. The engaging members 62 are located at a position engageable with the portions to be engaged 47 during the movement of the developing portion protecting member 65 from the opening position to the closing position performed in interrelation with the rotational movement of the grip portion 56 from the second rotation angle position to the first rotation angle position in the state in which the developing cartridge 3 is mounted to the mounting portion. As a result, the developing cartridge 3 is prevented from being disengaged from the mounting portion. Then, the engaging member 62 is located at a position, in which the engaging member 62 is not engageable with the portion to be engaged 47, after the developing portion protecting member 65 is moved to the closing position.

In the case where the developing cartridge 3 is mounted to the mounting portion in the state in which the grip portion 56 is rotationally moved to the second rotation angle position, the engaging member 62 interferes with the portion to be engaged 47 to prevent the developing cartridge 3 from being mounted to the mounting portion.

Embodiment 2

Figure 13:
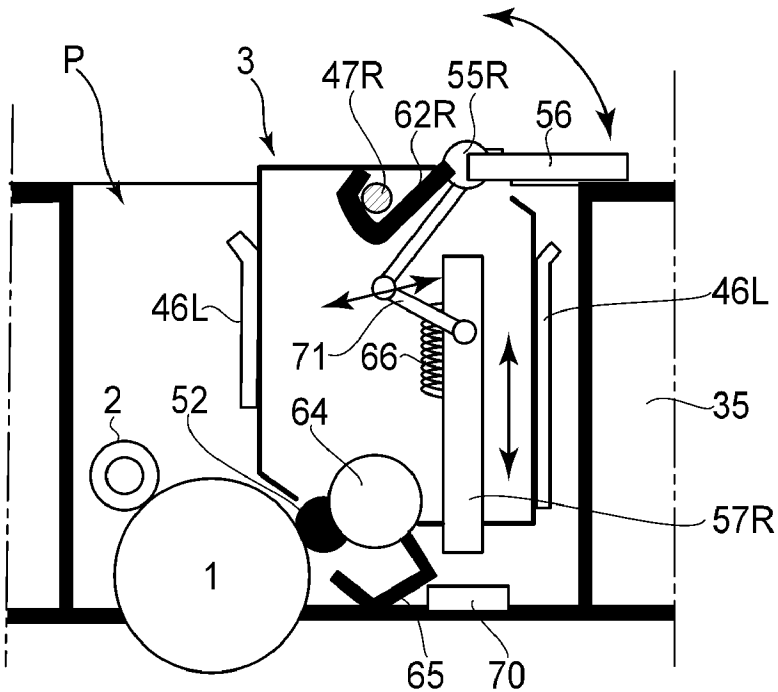
FIG. 13 is a schematic view for illustrating a constitution of Embodiment 2.

In Embodiment 1, the spacing cam 61 is used as the interrelating member, for shifting the developing cartridge 3 between the operable position and the separation position by the shifting member (the spacing rod) 57, operated in interrelation with the rotational operation of the grip portion 56 but the interrelating member usable in the present invention is not limited thereto. For example, as shown in FIG. 13, it is also possible to use a crank mechanism 71 as the interrelating member. That is, the grip portion 56 and the spacing rods 57L and 57R are connected by the crank mechanism 71, so that the spacing rods 57L and 57R can be vertically moved in interrelation with the rotational operation of the grip portion 56.

Further, in Embodiment 1, the shutter 65 as the developing portion protecting member is of the type wherein the shutter 65 is opened and closed by the rotational movement but the developing portion protecting member is not limited thereto. For example, such a type that the developing portion protecting member is opened and closed by a sliding operation.

In Embodiment 1, the developing roller 52 is used as the developing member but the developing member may also be a rotatable belt member in addition to the roller member.

In the above-described embodiments, the tray 35 as the movable member is configured to support the four image forming portions PY, PM, PC and PK disposed in parallel to each other with respect to the movement direction of the tray 35. However, the image forming portions to be supported by the tray 35 may also be a single image forming portion. Further, it is also possible to constitute the image forming apparatus in which two, three or five or more image forming portions are supportable by the tray 35 in parallel to each other.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 239271/2008 filed Sep. 18, 2008, which is hereby incorporated by reference.

What is claimed is:

1. A developing cartridge detachably mountable to a developing cartridge mounting portion of an image forming apparatus for forming an image on a recording material, said developing cartridge comprising:

a developer carrying member for supplying a developer to an image bearing member to develop a latent image formed on the image bearing member;

a protecting member provided movably between a closing position in which said protective member covers said developer carrying member and an opening position in which said protective member exposes said developer carrying member;

a shifting member for shifting said developing cartridge, mounted to the developing cartridge mounting portion, between a operable position in which said developer carrying member operably opposes the image bearing member and a separation position in which said developer carrying member is moved away from the image bearing member with respect to the operable position;

a grip portion provided movably between a first position and a second position; and an interrelating member for interrelating said developing cartridge with said grip portion, wherein in a state in which said developing cartridge is mounted to the developing cartridge mounting portion, said interrelating member shifts said developing cartridge from the separation position to the operable position by said shifting member while moving said protecting member from the closing position to the opening position in interrelation with movement of said grip portion from the first position to the second position, and shifts said developing cartridge from the operable position to the separation position by said shifting member while moving said protecting member from the opening position to the closing position in interrelation with movement of said grip portion from the second position to the first position.

2. A cartridge according to claim 1, further comprising holding means for holding said grip portion at the first position and at the second position.

3. A cartridge according to claim 1, wherein said developing cartridge is shifted from the separation position to the operable position after said protecting member is moved from the closing position to the opening position in interrelation with the movement of said grip position from the first position to the second position, and wherein said protecting member is moved from the opening position to the closing position after said developing cartridge is shifted from the operable position to the separation position in interrelation with the movement of the grip portion from the second position to the first position.

4. A cartridge according to claim 1, wherein the developing cartridge mounting portion comprises a portion to be engaged and said developing cartridge comprises an engaging member engageable with the portion to be engaged in interrelation with the movement of the grip portion, and wherein in the state in which said developing cartridge is mounted to the developing cartridge mounting portion, the engaging member and the portion to be engaged are engaged with each other in order to prevent disengagement of said developing cartridge from the developing cartridge mounting portion during the movement of said protecting member from the opening position to the closing position in interrelation with the movement of said grip portion from the second position to the first position and are disengaged from each other after said protecting member is moved from the opening position to the closing position.

5. A cartridge according to claim 4, wherein when said developing cartridge is mounted to the developing cartridge mounting portion in a state in which said grip portion is located at the second position, the engaging member interferes with the portion to be engaged to prevent said developing cartridge from being mounted to the developing cartridge mounting portion.

6. An image forming apparatus for forming an image on a recording material, comprising:

a movable member, which supports an image bearing member and includes a developing cartridge mounting portion, movable between an outside position in which said movable member is located outside a main assembly of said image forming apparatus and an inside position in which said movable member is located inside the main assembly of said image forming apparatus; and a developing cartridge detachably mountable to the developing cartridge mounting portion, said developing cartridge comprising:

a developer carrying member for supplying a developer to an image bearing member to develop a latent image formed on the image bearing member;

a protecting member provided movably between a closing position in which said protective member covers said developer carrying member and an opening position in which said protective member exposes said developer carrying member;

a shifting member for shifting said developing cartridge, mounted to the developing cartridge mounting portion, between a operable position in which said developer carrying member operably opposes the image bearing member and a separation position in which said developer carrying member is moved away from the image bearing member with respect to the operable position;

a grip portion provided movably between a first position and a second position; and an interrelating member for interrelating said developing cartridge with said grip portion, wherein in a state in which said developing cartridge is mounted to the developing cartridge mounting portion, said interrelating member shifts said developing cartridge from the separation position to the operable position by said shifting member while moving said protecting member from the closing position to the opening position in interrelation with movement of said grip portion from the first position to the second position, and shifts said developing cartridge from the operable position to the separation position by said shifting member while moving said protecting member from the opening position to the closing position in interrelation with movement of said grip portion from the second position to the first position.

7. A cartridge according to claim 6, wherein said developing cartridge includes a plurality of developing cartridge portions arranged in parallel to each other, and wherein said movable member is capable of supporting the plurality of developing cartridge portions.

* * * * *